US010499717B2

(12) United States Patent
Chinlund

(10) Patent No.: US 10,499,717 B2
(45) **Date of Patent: *Dec. 10, 2019**

(54) JEWELRY STORAGE AND DISPLAY CASE

(71) Applicant: Colleen Chinlund, Chicago, IL (US)

(72) Inventor: Colleen Chinlund, Chicago, IL (US)

(73) Assignee: LASSO IT, LLC, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/804,264

(22) Filed: Nov. 6, 2017

(65) Prior Publication Data

US 2018/0055168 A1 Mar. 1, 2018

Related U.S. Application Data

(63) Continuation of application No. 15/048,317, filed on Feb. 19, 2016, now Pat. No. 9,833,051.

(51) Int. Cl.

| | |
|---|---|
| ***A45C 11/16*** | (2006.01) |
| ***A45C 13/02*** | (2006.01) |
| ***A45C 13/10*** | (2006.01) |
| ***A47F 7/02*** | (2006.01) |
| ***A47F 7/03*** | (2006.01) |

(52) U.S. Cl.

CPC ..... *A45C 11/16* (2013.01); *A45C 13/02* (2013.01); *A45C 13/1069* (2013.01); *A47F 7/02* (2013.01); *A47F 7/03* (2013.01); *A45C 2200/10* (2013.01)

(58) Field of Classification Search

CPC ..... A45C 11/16; A45C 13/02; A45C 13/1069; A45C 2200/10; A47F 7/022; A47F 7/02; A47F 7/024; A47F 7/17; A47F 7/03; A47G 29/00

USPC ..... 211/85.2, 85.5, 183; 206/6.1, 389

See application file for complete search history.

(56) References Cited

U.S. PATENT DOCUMENTS 1,831,401 A * 11/1931 Weidlich ..... A45C 11/16 211/133.1
2,225,998 A * 12/1940 Katz ..... B65D 5/5019 206/566
2,410,161 A * 10/1946 Helbein ..... A45C 11/12 206/565
3,378,136 A * 4/1968 Lubin ..... A47G 1/12 206/6.1

(Continued)

FOREIGN PATENT DOCUMENTS

CN 103504757 A 1/2014
DE 2032156 A1 1/1972

(Continued)

OTHER PUBLICATIONS

Search Report for International application No. PCT/US2017/018574, dated May 16, 2017.

(Continued)

*Primary Examiner* — Jennifer E. Novosad
(74) *Attorney, Agent, or Firm* — Marshall, Gerstein & Borun LLP

(57) ABSTRACT

A jewelry storage case includes a spool having a cylindrical hollow body, a first slot at a first end, and a second slot at a second end. The first and second slots are sized and shaped to receive an end of a jewelry item that is secured to the spool. The spool may be disposed in a base and protected by a cover that is removably attached to the base.

17 Claims, 11 Drawing Sheets

(56) References Cited

U.S. PATENT DOCUMENTS 3,650,382 A * 3/1972 Braun ..... A45C 11/16 206/6.1
3,788,489 A * 1/1974 Levinthal ..... A47F 5/04 211/163
3,997,050 A * 12/1976 Patterson ..... A45C 11/16 206/566
4,120,394 A 10/1978 Soltes
4,141,453 A * 2/1979 Hanan ..... A47F 7/02 211/163
4,322,007 A * 3/1982 Feibelman ..... A47F 7/02 211/163
4,390,099 A * 6/1983 Trautlein ..... A47F 7/02 211/163
4,442,942 A * 4/1984 Cuminale ..... A47F 7/024 211/1.54
4,461,383 A * 7/1984 Groff ..... A47F 7/03 206/566
4,552,264 A * 11/1985 Quarrell ..... A47F 7/03 206/458
4,671,415 A * 6/1987 Manhart ..... A47F 7/02 211/40
4,726,469 A * 2/1988 Farber ..... A45C 11/12 206/301
4,850,658 A * 7/1989 Sandor ..... A47F 5/02 312/225
4,875,593 A * 10/1989 Trimble ..... A47K 3/281 211/95
4,919,286 A 4/1990 Agbay, Sr.
4,964,520 A * 10/1990 Kilmartin, III ..... A47F 5/04 211/131.1
4,971,593 A * 11/1990 Mayhall ..... A63H 3/50 211/70
5,054,624 A * 10/1991 Camp ..... A47F 5/02 211/163
5,117,971 A * 6/1992 Fisher ..... A47F 7/03 206/486
5,168,985 A * 12/1992 Shih ..... A47F 7/02 206/566
5,176,263 A * 1/1993 Caruso ..... A47F 7/02 206/495
5,211,284 A * 5/1993 Parks ..... A45C 11/16 206/348
5,449,073 A * 9/1995 DeBeverly ..... A47F 5/04 211/168
5,487,600 A * 1/1996 Griffin ..... A47F 3/10 211/129.1
5,499,726 A * 3/1996 Mitchell ..... A47F 5/16 211/183
5,531,349 A 7/1996 Wojcik et al.
5,603,401 A * 2/1997 Brunner ..... B65D 25/16 206/204
5,617,947 A * 4/1997 Momjian ..... A44C 5/10 206/566
5,653,339 A * 8/1997 Dobson ..... B65D 85/42 206/408
5,678,908 A * 10/1997 Wang ..... A45C 11/16 312/122
5,758,936 A 6/1998 Baughan
5,833,052 A * 11/1998 Diamond ..... A45C 11/16 206/6.1
5,924,570 A 7/1999 Sickles
6,206,208 B1 * 3/2001 Dennig ..... A47F 7/02 211/85.2
6,241,105 B1 * 6/2001 Pomper ..... A47F 5/04 206/6.1
6,422,384 B1 * 7/2002 Roederer ..... A45C 11/16 206/566
6,648,132 B1 * 11/2003 Smouha ..... A45C 11/12 206/301
6,672,463 B2 1/2004 Dashefsky
7,383,959 B1 * 6/2008 Rudd ..... A47F 7/00 211/13.1
D624,331 S * 9/2010 Kosten ..... D6/674
7,789,224 B2 9/2010 Diamond
7,891,506 B2 * 2/2011 Kornowski ..... A45C 11/16 211/163
8,210,370 B2 * 7/2012 Botkin ..... A47F 5/0892 211/117
D665,197 S * 8/2012 Allameh ..... D6/661.3
8,567,614 B2 * 10/2013 Sankey ..... A47F 5/02 211/7
9,066,611 B1 * 6/2015 Bailey ..... A45C 11/16
D734,037 S * 7/2015 Coon ..... D3/315
9,078,499 B1 * 7/2015 Brabec ..... A45C 11/16
9,833,051 B2 * 12/2017 Chinlund ..... A47F 7/03
2003/0192840 A1 * 10/2003 Hoyle ..... A47F 5/05 211/85.2
2006/0289321 A1 * 12/2006 Karfias ..... A45C 11/16 206/413
2008/0098709 A1 * 5/2008 Diamond ..... A45C 11/16 59/80
2008/0135422 A1 * 6/2008 Martinez ..... A47F 7/02 206/6.1
2009/0026158 A1 * 1/2009 Mangano ..... A45C 11/16 211/85.2
2009/0072680 A1 * 3/2009 Hofherr ..... A45C 11/16 312/135
2009/0127138 A1 * 5/2009 Allameh ..... A47F 5/02 206/6.1
2010/0300900 A1 * 12/2010 Quan ..... A45C 11/16 206/6.1
2015/0001128 A1 * 1/2015 Jaffe ..... A45C 11/16 206/581
2015/0027910 A1 * 1/2015 Li ..... A45C 11/16 206/6.1
2015/0122756 A1 * 5/2015 Strulson ..... A47F 7/02 211/85.2

FOREIGN PATENT DOCUMENTS

ES 1060997 U 12/2005
KR 101371672 B1 3/2014

OTHER PUBLICATIONS

Written Opinion for International application No. PCT/US2017/018574, dated May 16, 2017.
U.S. Office Action for U.S. Appl. No. 15/048,317, dated Apr. 24, 2017.
European Patent Application No. 17754016.8, Extended European Search Report, dated Aug. 21, 2019.

* cited by examiner

JEWELRY STORAGE AND DISPLAY CASE

CROSS REFERENCE TO RELATED APPLICATION

This application is a continuation application of U.S. patent application Ser. No. 15/048,317, filed Feb. 19, 2016, the entirety of which is hereby incorporated by reference herein.

FIELD OF THE DISCLOSURE

The present disclosure generally relates to jewelry storage cases and more specifically to jewelry storage cases that prevent chain entanglement and protect jewelry items and that can also be used to display a pendant or charm.

BACKGROUND

When transporting necklaces, the necklaces are typically stored in a pouch or container where the chain portion of the necklace is pooled in a compartment. As a result of movement during transportation, the chain portion of the necklace often becomes tangled and knotted, occasionally to the point of rendering the necklace useless, because the knot cannot be undone. When displaying necklaces, for example in a retail store, a small box with a cardboard divider may be used to display the pendant portion of the necklace. However, most of the chain portion of the necklace is stored in a compartment behind the cardboard divider, and, as a result, is subject to tangling and knotting as described above.

In order to solve the problem of tangling and knotting, some home necklace storage devices, such as jewelry cabinets, have been produced include have hooks. The necklace is placed on the hook and the presumption is that gravity will keep the chain portion of the necklace straight and not subject to tangling or knotting. However, any disturbance of these types of storage devices will result in the chain portion moving within the device. As a result, these types of storage devices are not well suited for transportation of necklaces.

DETAILED DESCRIPTION

Figure 1:
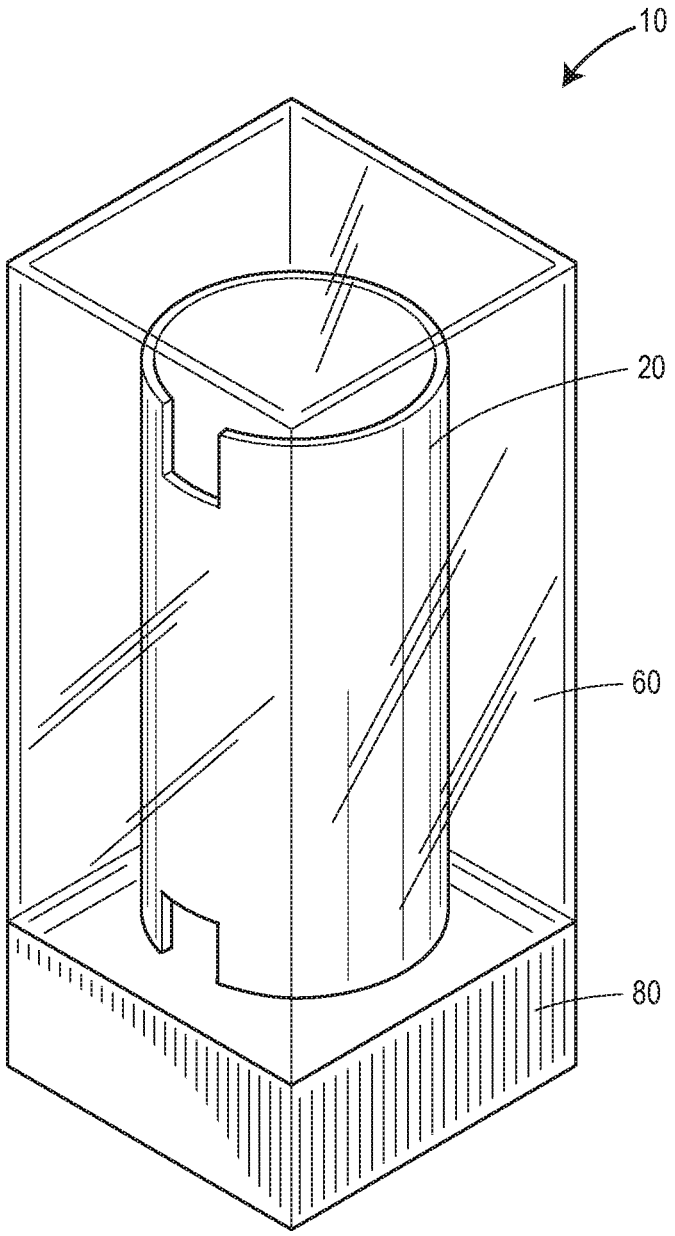
FIG. 1 is a perspective view of a jewelry storage device constructed in accordance with the teachings of the disclosure.
Figure 2A:
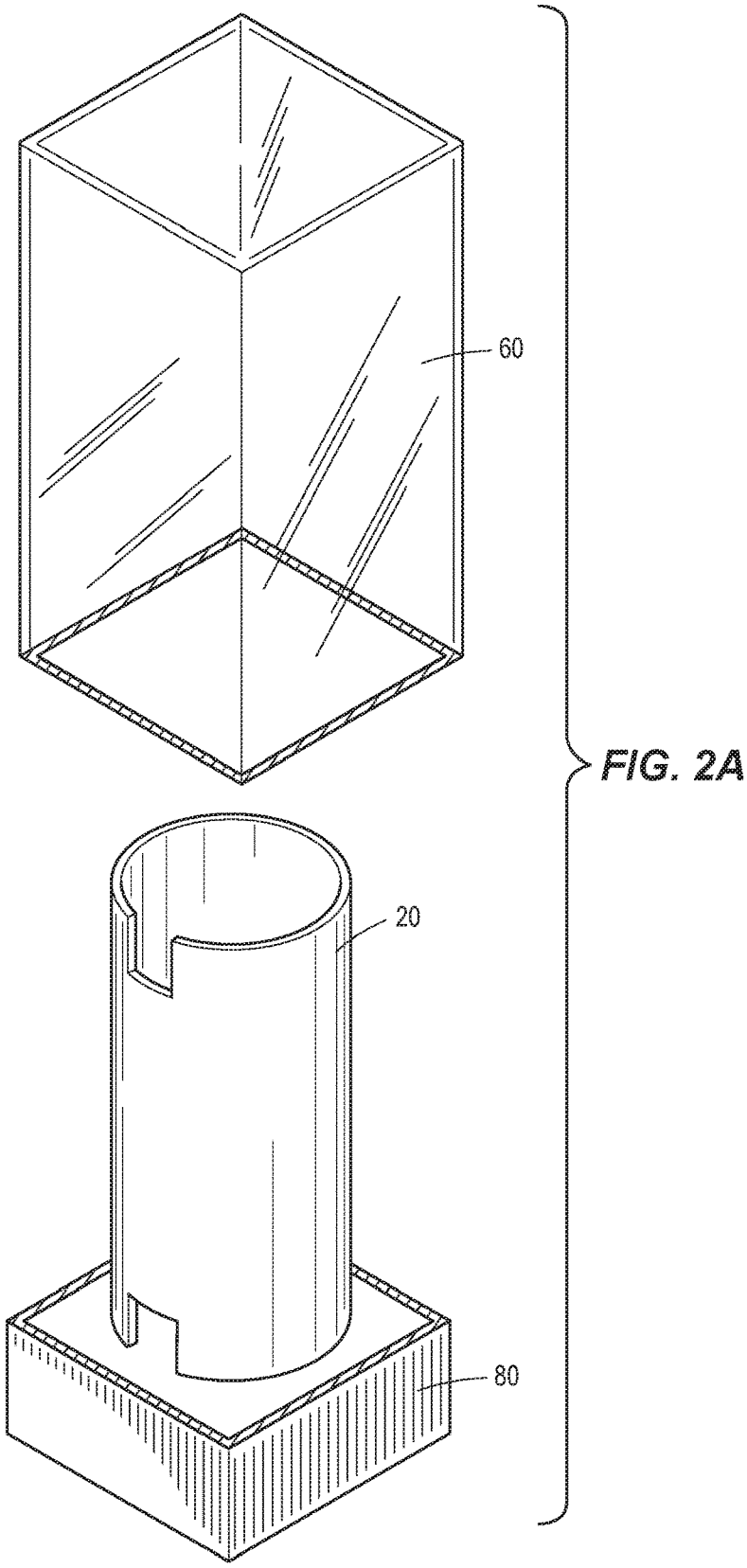
FIG. 2A is a perspective exploded view of the jewelry storage device of FIG. 1.
Figure 2B:
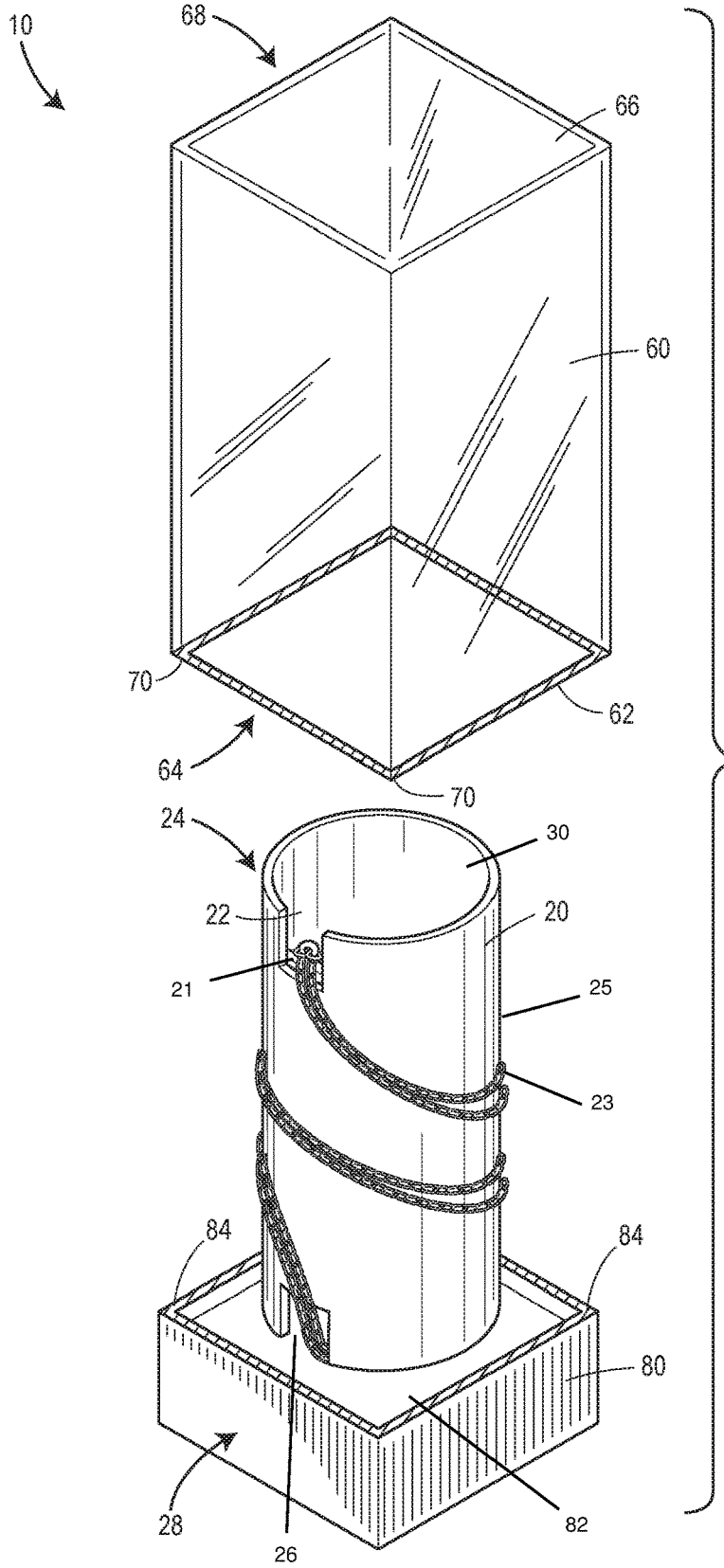
FIG. 2B is a perspective exploded view of the jewelry storage device of FIG. 1, including a jewelry item stored on a spool of the jewelry storage device.

Turning now to FIGS. 1, 2A, and 2B, one embodiment of a jewelry storage device 10 is illustrated. The jewelry storage device 10 generally includes a body portion or spool 20, a base 80, and a cover 60. A jewelry item, such as a pendant 21 and chain 23, may be wrapped around the spool 20, to keep the chain from getting kinked or knotted. The spool 20 may be removably mounted on the base such that the spool 20 and base 80 can remain upright for easy viewing of the jewelry item. The cover 60 may be disposed over the spool 20 during storage. In the embodiment illustrated in FIGS. 1, 2A, and 2B, the cover 60 is illustrated as being transparent. In other embodiments, the cover may be translucent or opaque. The cover 60 may be removably secured to the base 20 with a removable connection, such as a magnetic connection or a snap-fit connection. Regardless, the spool 20, the cover 60, and the base 80 form an easily transportable, compact, jewelry storage device 10 that prevents kinks or knots from forming in a chain portion of the jewelry item.

In FIGS. 2A and 2B, the jewelry storage device 10 is illustrated in a partially exploded diagram with the cover 60 being removed from the base 80. The spool 20 is a hollow cylinder. The spool 20 may have a generally circular cross-sectional shape, as illustrated in FIGS. 2A and 2B. In other embodiments, the spool 20 may have other cross-sectional shapes, such as oval, square, triangular, polygonal, or irregular, as long as a chain portion of a jewelry item can be wound around an outer surface of the spool 20. The spool 20 may have a first slot 22 at a first end 24 and a second slot 26 at a second end 28. The first slot 22 and the second slot 26 are sized to allow the pendant 21 and/or a clasp portion of the jewelry item to pass through the first slot 22 or through the second slot 26 so that the pendant 21 or clasp portion is disposed within the hollow interior 30 of the spool 20, while allowing the chain portion to be wound around the outer surface 25 of the spool 20. The base 80 may include a stabilizing member, such as a depression 82, that is sized and shaped to at least partially receive the second end 28 of the spool 20 so that the spool 20 is supported in an upright position and the base 80 supports the spool 20 such that the spool 20 and the base 80 together may be placed on a horizontal surface and the spool 20 and the base 80 would remain in an upright position.

The cover 60 may include an opening 62 at a first end 64 and a top wall 66 at a second end 68. The first end 64 may include a securing element, such as a first plurality of magnets 70 that cooperate with a complimentary securing element, such as a second plurality of magnets 84 located on the base 80. In other embodiments, other securing elements may be substituted for the first and second plurality of magnets 70, 84. For example, in other embodiments, one or more of the following releasable connections may be used: a snap-fit connection, a removable fastener connection, a clasp and post connection, a hook and loop fastener connection, or any other type of releasable connection that allows the cover 60 to be removably secured to the base 80.

Figure 3:
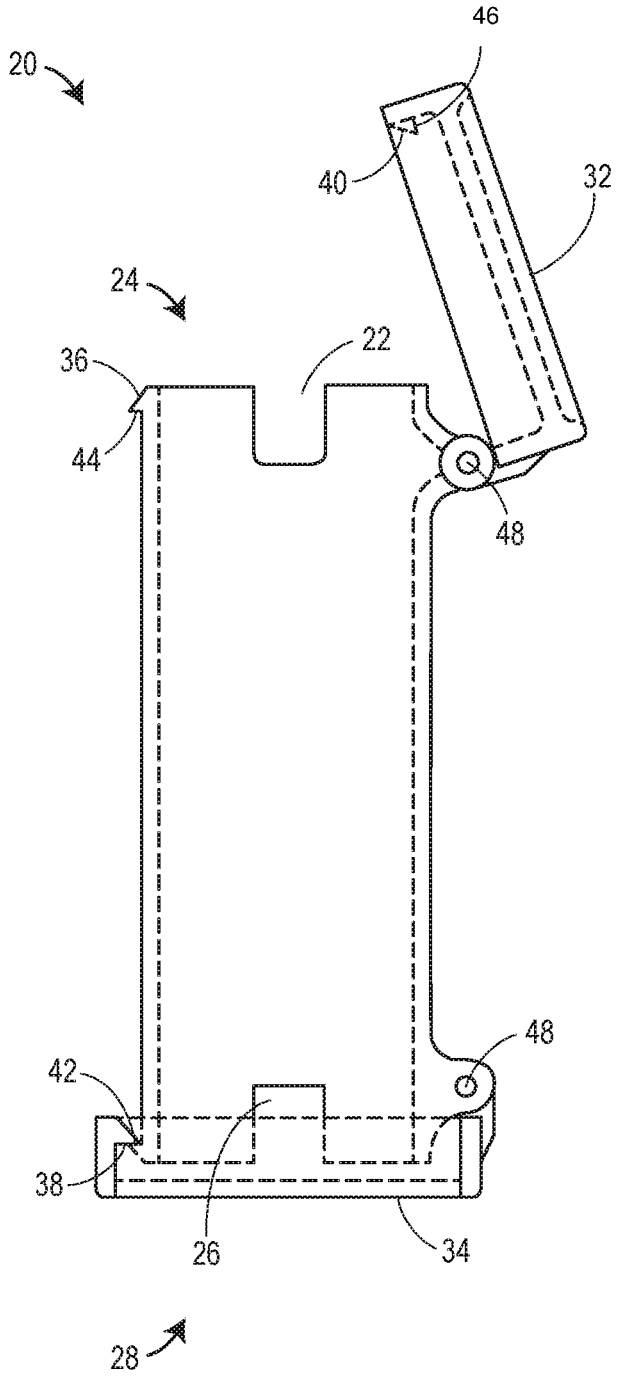
FIG. 3 is a side elevational view of a spool of the jewelry storage device of FIG. 1.
Figure 4:
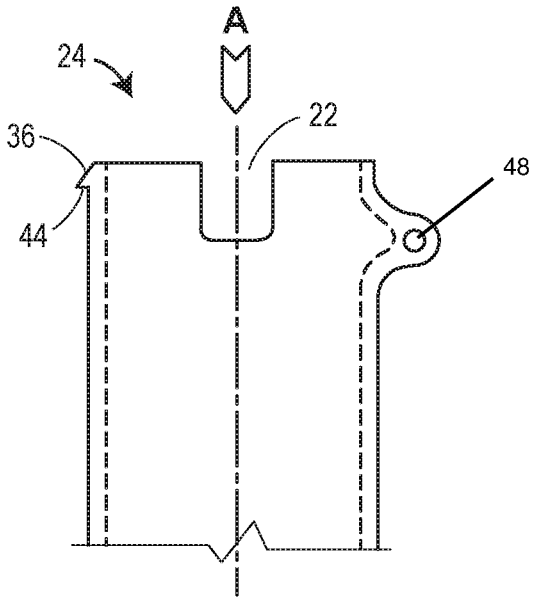
FIG. 4 is a close up side elevational view of a top of the spool of FIG. 3.

Turning now to FIGS. 3-7, one embodiment of the spool 20 is illustrated. The spool 20 may include a first cap 32 attached to the spool 20 proximate the first end 24 and a second cap 34 attached to the spool 20 proximate the second end 28. The first and second caps 32, 34, may be generally disc-shaped and complementary in shape to the cross-sectional shape of the spool so that the first and second caps 32, 34, fit over, and cover, the open first end 24 and the open second end 28 of the spool 20, as illustrated in FIG. 3. In FIG. 3, the first cap 32 is illustrated in an open position, leaving the open first end 24 exposed, and the second cap 34 is illustrated in a closed position, where the second open end 28 is covered by the second cap 34. The spool 20 illustrated in FIGS. 3-8 may be utilized as a stand-alone jewelry storage device without the base 80 or cover 60 of FIGS. 1, 2A, and 2B.

In the embodiment illustrated in FIGS. 3-7, the spool 20 is longitudinally reversible, meaning that the features of the spool 20 are oriented in the same way whether the spool 20 is held with the first end 24 up, or with the first end 24 down. In either case, one cap (whether the first cap or the second cap) is located proximate to the first end 24 and another cap is located proximate to the second end 28. In this way, the spool 20 illustrated in FIGS. 3-7 is orientation neutral with respect to the base 80. In other words, either end of the spool 20 may be placed in the base 80.

A first closure element 36 is located proximate the first end 24 and a second closure element 38 is located proximate the second end 28. The first closure element 36 interacts with a first cap closure element 40 to secure the first cap 32 in the closed position, covering the first end 24 of the spool 20. Similarly, the second closure element 38 interacts with a second cap closure element 42 to secure the second cap 34 in the closed position, covering the second end 28 of the spool 20. In the embodiment illustrated in FIGS. 3-7, the first and second closure elements 36, 38 take the form of flexible protrusions having a ledge 44 that is captured by a corresponding shelf 46 located on the first cap closure element 40. In other embodiment, other types of releasable connections may be used, such as a magnetic connection, a hook and loop fastener connection, a pin and clasp connection, etc.

In the embodiment illustrated in FIGS. 3-7, each of the first and second caps 32, 34 is attached to the spool 20 by a hinge 48 that allows the first and second caps 32, 34 to pivot away from the first and second ends 24, 28, respectively. In other embodiments, the first and second caps 32, 34, may be attached to the spool 20 by other types of connections, for example, a snap-fit connection or a magnetic connection.

Figure 5:
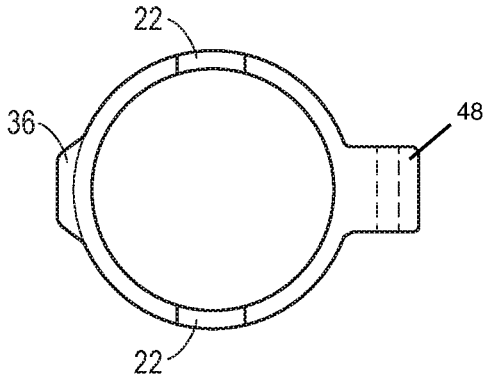
FIG. 5 is a top plan view of the spool of FIG. 3.
Figure 6:
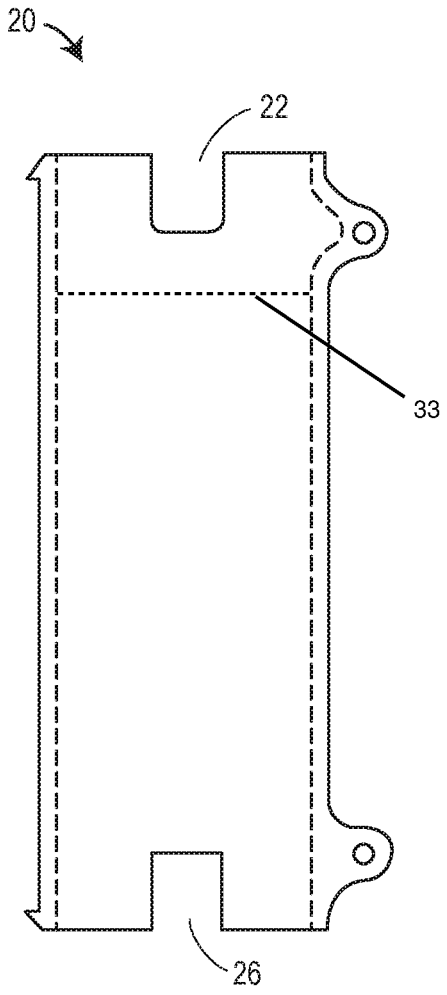
FIG. 6 is another side elevational view of the spool of FIG. 3 without caps.
Figure 7:
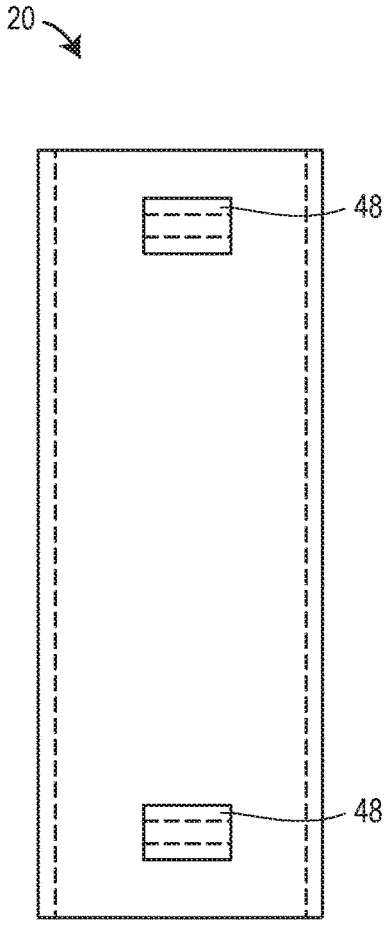
FIG. 7 is another side elevational view of the spool of FIG. 3 without the caps, the side view being rotated 90 degrees from the view of FIG. 6.
Figure 8:
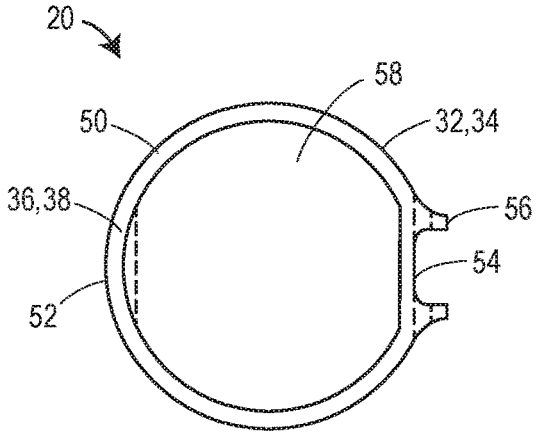
FIG. 8 is a top plan view of the cap of the jewelry storage device of FIG. 3.

The spool 20 may have more than one first slot 22, and/or more than one second slot 26, disposed at the first end 24 or at the second end 28, respectively. For example, as illustrated in FIG. 5, the first end 24 may include a plurality of first slots 22 disposed about the periphery of the first end 24. In the example illustrated in FIG. 5, the first slots 22 are oriented approximately 180 degrees apart from one another and approximately 90 degrees from the first closure element 36 and approximately 90 degrees from the hinge 48. Multiple slots 22 give a user more options on where to secure the jewelry item to the spool 20. Although not illustrated in the drawings, the second end 28 of the spool 20 may include a plurality of slots 26 as well. In other embodiments, the spool may include more than two first slots 22 and/or more than two second slots 26.

Figure 9:
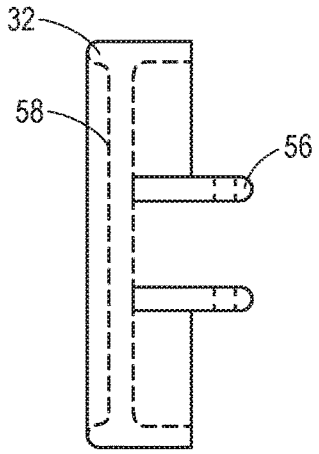
FIG. 9 is a rear elevational view of the cap of FIG. 8.
Figure 10:
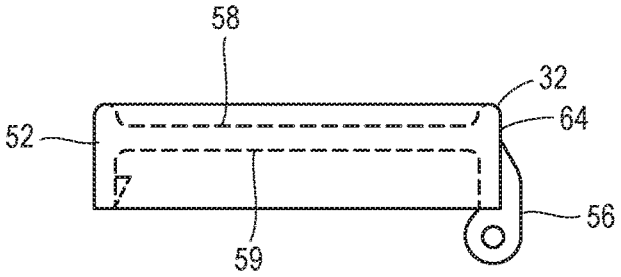
FIG. 10 is a side elevational view of the cap of FIG. 8.
Figure 11:
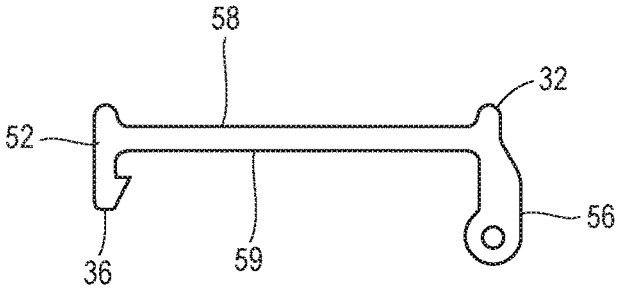
FIG. 11 is a side cross-sectional view of the cap of FIG. 8.

Turning now to FIGS. 8-11, one embodiment of the first cap 32 and/or the second cap 34 is illustrated. While the description that follows is directed to the first cap 32, the description applies equally to the second cap 34. The first cap 32 includes a generally disc-shaped body 50 having a front side 52 and a rear side 54. The first closure element 36 is located proximate to the front side 52 and hinge receivers 56 are located proximate the rear side 54. An outer surface 58 is recessed relative to the top of the disc-shaped body 50, as is illustrated in FIGS. 9-11. Similarly, an inner surface 59 is also recessed relative to the bottom of the disc-shaped body 50. When the first cap 32 is disposed over the first end 24 of the spool, the edges of the disc-shaped body 50 receive the first end 54 of the spool, thereby closing the first end 54 of the spool.

In operation, a user inserts one end of a chain of a jewelry item (for example, the clasp end) or the pendant 21 into the first slot 22, as illustrated in FIG. 2B. Thereafter, the first cap 32 is closed over the first end 24 of the spool 20 and the spool 20 is rotated while the user holds the chain 23 of the jewelry item. As the spool 20 is rotated, the chain 23 of the jewelry item becomes wound around the outer surface 25 of the spool 20. As the chain 23 becomes fully wound around the spool 20, the user may then place the opposite end of the jewelry item, for example, the pendant 21 or clasp end, in the second slot 26. Thereafter, the second cap 34 is closed over the second end 28 of the spool 20, thereby securing the jewelry item on the spool 20 and preventing the chain of the jewelry item from becoming kinked or knotted. The spool 20 itself may be used as a jewelry storage or transportation device. Alternatively, the spool 20 may be placed on the base 80 and the cover 60 may be secured to the base 80, as described above, to provide additional protection for the jewelry item.

In other embodiments, the first cap 32 and/or the second cap 34 may be transparent and a shelf or ledge 33 (FIG. 6) may be disposed within the spool 20 adjacent to the first slot 22 and/or the second slot 26, and offset longitudinally towards a center of the spool 20. When a jewelry item is secured to the spool 20, the pendant 21 of the jewelry item may be placed on the shelf or ledge 33 before the first or second cap 32, 34 is secured to the spool 20, the pendant 21 being oriented so that a face or ornamental side of the pendant 21 is facing outward, away from a center of the spool 20. In this manner, a user (or potential purchaser) of the jewelry item may view the pendant 21 through the first or second cap 32, 34 while the jewelry item is secured to the spool 20. As a result, the spool 20 itself may be used as both a transportation device and as a display device for the jewelry item. This configuration advantageously may be used to display jewelry items in a retail store for customers to view. Additionally, the spool 20 may be smaller than traditional jewelry display cases. As a result, more jewelry items per unit volume may be shipped to the retail store while secured to the spools 20. Thus, the disclosed jewelry storage device 10 (or the disclosed spool 20) provides economic transportation benefits over existing jewelry boxes. Furthermore, the disclosed spool 20 does not need to be opened to view the pendant on the jewelry item.

Figure 12:
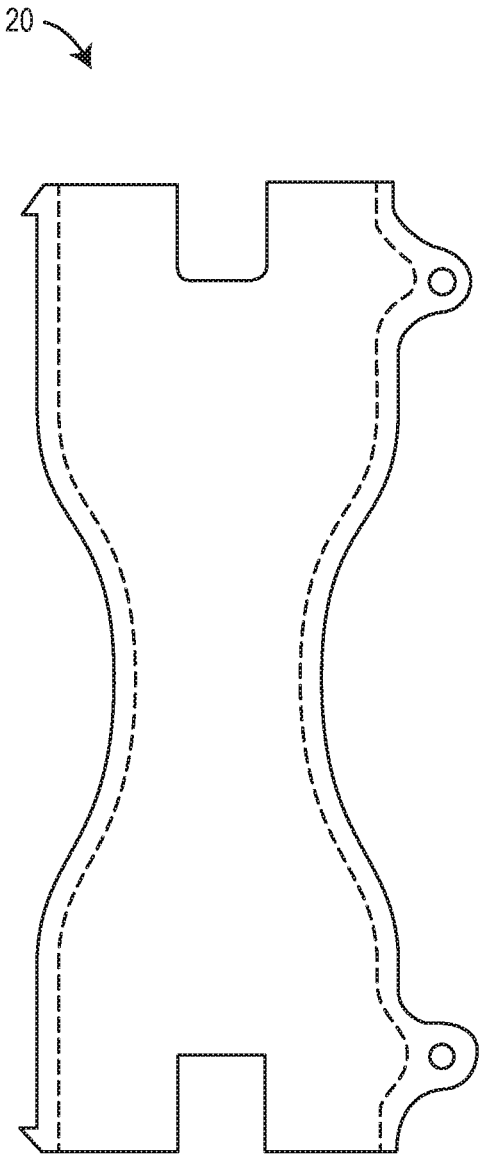
FIG. 12 is a side elevational view of an alternate embodiment of the spool of FIG. 3.
Figure 13:
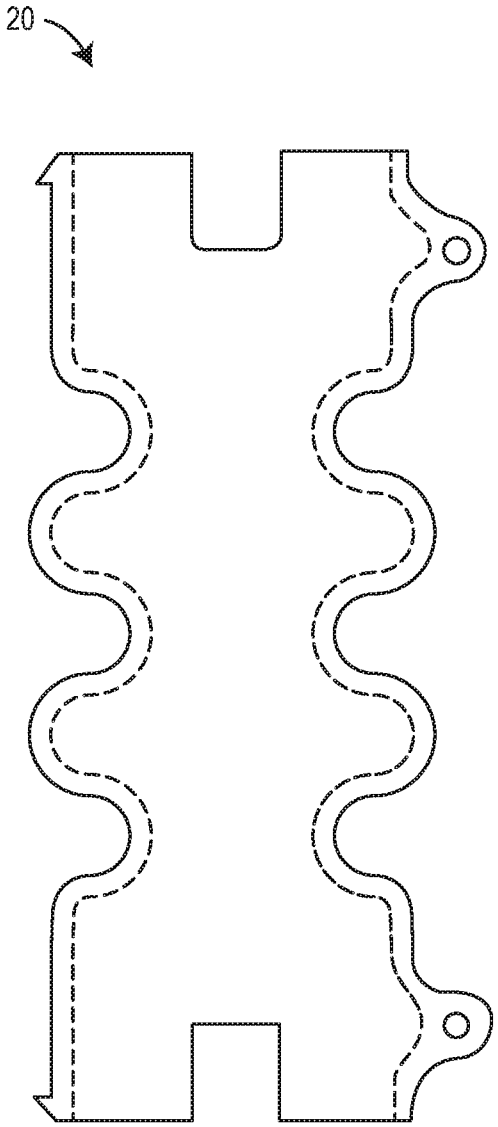
FIG. 13 is a side elevational view of yet another embodiment of the spool of FIG. 3.
Figure 14A:
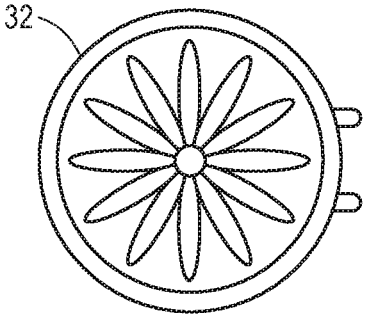
FIGS. 14A-E are top plan views of alternate embodiments of the cap of FIG. 8.
Figure 14B:
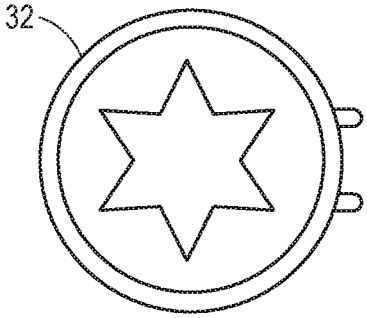
Figure 14C:
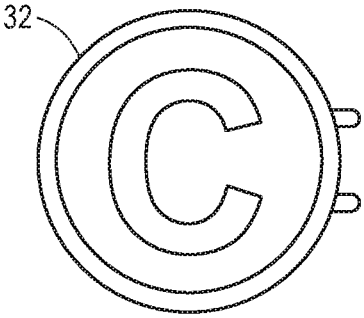
Figure 14D:
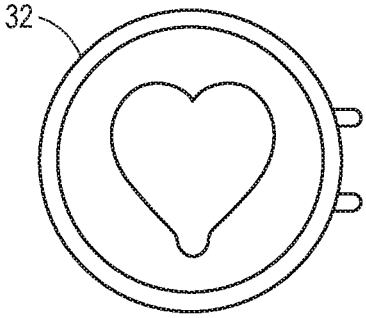
Figure 14E:
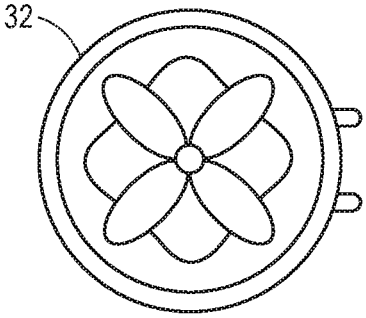

In some alternate embodiments, the outer surface of the spool may be shaped to secure the chain of the jewelry item to the spool in a certain configuration. For example, as illustrated in FIG. 12, the outer surface of the spool 20 may have an hourglass shape, being narrower towards a center of the spool 20 and wider near the first end 24 and near the second end 28. Alternatively, the outer surface of the spool 20 may have an irregular or undulating shape, as illustrated in FIG. 13. The irregular shape may include a series of circumferential peaks and circumferential valleys that encircle the outer surface of the spool 20. Each of the circumferential valleys may be sized to receive a width of the chain so that only a single coil of chain may be disposed in each valley. Alternatively, the circumferential peaks and valleys may form a corkscrew structure that guides the chain along a single valley from start to finish. In this manner, kinking or knotting of the chain may be further prevented.

In yet another alternate embodiment, as illustrated in FIGS. 14A-E, the first and/or second caps 32, 34 may have an extruded plastic shape on the outer surface 58 thereof. The extruded plastic shape may represent a shape of a pendant of a jewelry item that is secured to the spool 20, but hidden by the first or second cap 32, 34. In other embodiments, the shape may be an indicium printed or otherwise disposed on the outer surface 58.

While various embodiments have been described above, this disclosure is not intended to be limited thereto. Variations can be made to the disclosed embodiments that are still within the scope of the appended claims.

What is claimed:

1. A jewelry storage device comprising:

a spool having a hollow cylindrical body, a first end, and a second end;

a first slot disposed in the hollow cylindrical body proximate the first end;

a second slot disposed in the hollow cylindrical body proximate the second end;

a first cap attached to the hollow cylindrical body proximate the first end, the first cap being movable between a closed position in which the first cap covers the first end and an open position in which the first end is uncovered and exposed; and a second cap attached to the hollow cylindrical body proximate the second end, the second cap being movable between a closed position in which the second cap covers the second end and an open position in which the second end is uncovered and exposed, wherein at least one of the first cap and the second cap is attached to the hollow cylindrical body by a hinge, and wherein at least one of the first cap and the second cap includes an indicium disposed on an outer surface.

2. The jewelry storage device of claim 1, wherein a pendant of a jewelry item is disposed in the first slot and a clasp end of the jewelry item is disposed in the second slot, a chain of the jewelry item connecting the pendant and the clasp end, the chain being wrapped around an outer surface of the body of the spool.

3. The jewelry storage device of claim 1, further comprising a first closure element located proximate to the first end and a second closure element located proximate the second end; and a first cap closure element disposed on the first cap and a second cap closure element disposed on the second cap.

4. The jewelry storage device of claim 3, wherein one of the first and second closure elements comprises a flexible protrusion.

5. The jewelry storage device of claim 4, wherein the flexible protrusion includes a ledge and the cap closure element includes a shelf that cooperates with the ledge to releasably secure one of the first and second caps to the hollow cylindrical body.

6. The jewelry storage device of claim 1, wherein at least one of the first and second caps is transparent.

7. The jewelry storage device of claim 6, further comprising a shelf that is disposed within the hollow cylindrical body proximate the first end.

8. The jewelry storage device of claim 1, wherein the hollow cylindrical body has an hourglass-shape.

9. The jewelry storage device of claim 8, wherein the hourglass shape is narrower towards a center of the spool and wider near the first end of the spool and near the second end of the spool.

10. The jewelry storage device of claim 1, wherein the hollow cylindrical body has an undulating shape having circumferential peaks and circumferential valleys.

11. The jewelry storage device of claim 10, wherein the circumferential peaks and circumferential valleys form a corkscrew structure.

12. The jewelry storage device of claim 1, further comprising a plurality of first slots proximate the first end and a plurality of second slots proximate the second end.

13. The jewelry storage device of claim 1, wherein at least one of the first cap and the second cap includes a disc-shaped body and an outer surface that is recessed relative to a top of the disc-shaped body.

14. The jewelry storage device of claim 1, wherein at least one of the first cap and the second cap includes a disc-shaped body and an inner surface that is recessed relative to a bottom of the disc-shaped body.

15. A jewelry storage device comprising:

a spool having a hollow cylindrical body, a first end, and a second end;

a first slot disposed in the hollow cylindrical body proximate the first end;

a second slot disposed in the hollow cylindrical body proximate the second end;

a first cap attached to the hollow cylindrical body proximate the first end, the first cap being movable between a closed position in which the first cap covers the first end and an open position in which the first end is uncovered and exposed; and a second cap attached to the hollow cylindrical body proximate the second end, the second cap being movable between a closed position in which the second cap covers the second end and an open position in which the second end is uncovered and exposed, wherein at least one of the first cap and the second cap is attached to the hollow cylindrical body by a hinge, wherein a pendant of a jewelry item is disposed in the first slot and a clasp end of the jewelry item is disposed in the second slot, a chain of the jewelry item connecting the pendant and the clasp end, the chain being wrapped around an outer surface of the body of the spool, and wherein at least one of the first cap and the second cap includes an extruded plastic shape on an outer surface.

16. The jewelry storage device of claim 15, wherein the extruded plastic shape represents a shape of the pendant.

17. A jewelry storage device comprising:

a spool having a hollow cylindrical body, a first end, and a second end;

a plurality of first slots proximate the first end and a plurality of second slots proximate the second end;

a first cap attached to the hollow cylindrical body proximate the first end, the first cap being movable between a closed position in which the first cap covers the first end and an open position in which the first end is uncovered and exposed; and a second cap attached to the hollow cylindrical body proximate the second end, the second cap being movable between a closed position in which the second cap covers the second end and an open position in which the second end is uncovered and exposed;

wherein at least one of the first cap and the second cap is attached to the hollow cylindrical body by a hinge, and wherein the plurality of first slots includes two slots that are oriented approximately 180 degrees from one another about a periphery of the spool and the two slots are oriented approximately 90 degrees from the hinge about the periphery of the spool.

* * * * *